US005252030A

United States Patent [19]

Chikada

[11] Patent Number: 5,252,030

[45] Date of Patent: Oct. 12, 1993

[54] AUTOMATIC OPERATION APPARATUS FOR VENTILATING FAN

[75] Inventor: Hirokazu Chikada, Komaki, Japan

[73] Assignee: Matsushita Seiko Co., Ltd., Osaka, Japan

[21] Appl. No.: 960,051

[22] Filed: Oct. 14, 1992

[30] Foreign Application Priority Data

Oct. 18, 1991 [JP] Japan ..... 3-270749
Oct. 18, 1991 [JP] Japan ..... 3-270750

[51] Int. Cl.[5] ..... F24F 7/013; F24F 11/02

[52] U.S. Cl. ..... 417/12; 417/14; 417/63; 454/343

[58] Field of Search ..... 417/12, 14, 63; 454/357, 342, 343, 349

[56] References Cited

U.S. PATENT DOCUMENTS 3,672,128 6/1972 Heffron ..... 55/222
3,826,180 7/1974 Hayashi ..... 98/43
4,251,026 2/1981 Siegel et al. ..... 417/12

FOREIGN PATENT DOCUMENTS 47-30761 9/1972 Japan .
59-221542 12/1984 Japan ..... 454/357
3-41220 8/1991 Japan .

*Primary Examiner*—Richard A. Bertsch
*Assistant Examiner*—David W. Scheuermann
*Attorney, Agent, or Firm*—Stevens, Davis, Miller & Mosher

[57] ABSTRACT

A smoke sensor detects a smoke density in a room so as to automatically start the operation of a ventilating fan when the smoke density exceeds a predetermined value, but stops the operation of the ventilating fan when the smoke density becomes lower than the predetermined value. When the predetermined time elapses after the operation of the ventilating fan is automatically stopped, the operation of the ventilating fan is restarted to produce an air stream in the room to be ventilated in order to make the smoke density uniform in the room, thereby it is possible to enhance the degree of accuracy for detection by the smoke sensor so as to make the automatic operation of the ventilating fan appropriate.

5 Claims, 5 Drawing Sheets

AUTOMATIC OPERATION APPARATUS FOR VENTILATING FAN

BACKGROUND OF THE INVENTION

The present invention relates to an automatic operation apparatus for automatically operating a ventilating fan in accordance with a density smoke generated from such a cigarette or the like in a room.

RELATED ART

These years, ventilating fans for ventilating a room, which each incorporate an automatic operation apparatus so as to be adapted to cope with an atmosphere of the inside of a room, that is, to automatically operate in accordance with a density of smoke generated from a cigarette or the like in the room, have been more and more prosperously available.

An automatic operation apparatus of this kind of related art, as shown in FIG. 5, automatically starts the operation of a ventilating fan 105 having a discharge port 103 at its one side surface and a suction port 104 at its lower surface and installed at the ceiling 103 of a room 101 when a detection signal from a smoke sensor 106 for detecting a density of smoke in the room 101, which is provided in the vicinity of the suction port 104 of the ventilating fan 105 exceeds a reference value, so that contaminated air in the room 101 is sucked through the suction port 104 and is discharged to the outside (which is not some) from the discharge port 103, and then stops the operation of the ventilating fan 105 when the detection signal from the smoke sensor 106 becomes lower than the reference value.

Further, as shown in this figure, in the automatic operation apparatus of this kind, the sensor is in general incorporated in a control circuit casing. This arrangement will be explained hereinbelow with reference to FIGS. 6 to 8.

As shown in these figures, an electronic circuit board 108 incorporating thereon a heat activation type smoke sensor 106 for detecting an atmosphere such as a density of smoke from, for example, a cigarette or the like is stored in a box-like control circuit casing 107 which is provided in a ventilating fan body 105 having a discharge opening 103 at one side surface and a suction port 104 at its lower surface, in a part in the vicinity of the suction port 104. Further the smoke sensor 106 incorporates therein a smoke detection element 109 for converting a smoke density into a resistance value and a heater 110 for heating the smoke detection element 109. By heating the smoke detection element 109 with the use of the heater 110, the resistance value can be changed sensitively even by a bit volume of smoke. Further, an opening 111 for communicating the inside of the control circuit 107 with the inside of the room is formed at the lower surface of the control circuit casing 107 in the vicinity of the smoke sensor 106 (in a condition as shown in FIG. 7). Further, the air in the room is introduced through the opening 111 into the control circuit casing 107 which has therefore the same atmosphere as that of the inside of the room, and this atmosphere is detected by the smoke sensor 106 in order to automatically operate the ventilating fan.

Such an automatic operation apparatus for the ventilating fan of related art has offered such a disadvantage that the ventilating fan 105 remains stopping although the air surrounding the user is contaminated, and accordingly, the operation of the ventilating fan 105 cannot perform ventilation that can cope with the atmosphere surrounding the user if a smoke cannot reach the smoke sensor 106 so that a difference in smoke density occurs between the area surrounding the user and the area around the smoke sensor 106 since the room 1 in which the ventilating fan 105 is installed, has a wide space or since the position of the installed ventilating fan 105 is high so that the distance between the smoke sensor 103 and a source of smoke is long.

Further, the above-mentioned control circuit casing for an automatic ventilating fan of related art has offered such a disadvantage that a heat from the smoke detection element 109 heated in the control circuit casing 107 is sucked from the opening 111 so as to abruptly cool the smoke detection element 109, resulting in a variation in the resistance value, and accordingly, an actual smoke density cannot be precisely detected since the control circuit casing 107 is located in the vicinity of the suction port 104 so that the stream of air sucked from the suction port 104 dashes below the opening 11 in the case of sucking contaminated air from the inside of the room through the suction port 104 and discharging the same outside of the room from the discharge port 103.

SUMMARY OF THE INVENTION

The present invention is devised in order to solve the above-mentioned problems inherent to the related art, and accordingly, one object of the present invention is to provide an automatic operation apparatus for a ventilating fan which can prevent occurrence of a difference in smoke density between the area surrounding the user and the area around the smoke sensor even if the room in which the ventilating fan is installed, has a wide space or if the position of the installed ventilating fan is high so that the distance between the smoke sensor and a source of smoke is long, resulting in that generated smoke cannot reach the smoke sensor, thereby it is possible to perform ventilation coping with an atmosphere surrounding the user.

Further, a second object of the present invention is to provide an automatic operation apparatus for a ventilating fan, incorporating a control circuit casing which can prevent the sensor from failing to precisely detect an atmosphere of the inside of the room, being caused by the stream of air sucked through the suction port upon operation of the ventilating fan.

In order to attain the first object of the present invention, there is provided an automatic operation apparatus for a ventilating fan, comprising a smoke sensor for detecting a smoke density in a room, a first operation means for starting and stopping the operation of the ventilating fan and a second operation means for operating the ventilating fan for a predetermined time if the ventilating fan remains stopping for a predetermined time.

Further, the second operation means counts a time from the time when the first operation means stops the operation of the ventilating fan, and starts the operation of the same when the predetermined time elapses.

The first operation means starts the operation of the ventilating fan when a detection signal from the smoke sensor exceeds a reference value, and stops the operation of the ventilating fan when it is lower than the reference value.

Further, in order to attain the second object of the present invention, the smoke sensor is provided in a control circuit casing having an opening and arranged in the vicinity of the suction port of the ventilating fan body, and an air stream blocking plate projected outward is provided in the vicinity of the opening of the control circuit casing.

Moreover, the air stream blocking plate provided in the opening of the control circuit casing, is projected so as to shield the periphery of the opening.

With the above-mentioned arrangement according to the present invention, the second operation means starts the operation of the ventilating fan for a predetermined time if smoke generated in the room does not reach the smoke sensor so that a difference in smoke density occurs between the area surrounding the user and the area around the smoke sensor, resulting in that the ventilating fan remains stopping for a predetermined time, and accordingly, contaminated air around the user can be led through the area around the smoke sensor and then be surely discharged outside of the room while the smoke density in the room is made to be uniform.

Further, with the above-mentioned arrangement, when contaminated air in the room is discharged outside of the room after it is sucked through the suction port during the operation of the ventilating fan, the air stream to be discharged is blocked by the air stream blocking plate in the vicinity of the opening of the control circuit casing, and accordingly, the air stream cannot dash below the opening so as to avoid abruptly cooling the smoke detection element, thereby it is possible to precisely detect an actual smoke density. Other features and advantages of the present invention will be apparent from the following description taken in connection with the accompanying drawings in which:

DESCRIPTION OF THE PREFERRED EMBODIMENTS

Explanation will be made of an automatic operation apparatus for a ventilating fan in a first embodiment of the present invention with reference to FIGS. 1 and 2.

Figure 1:
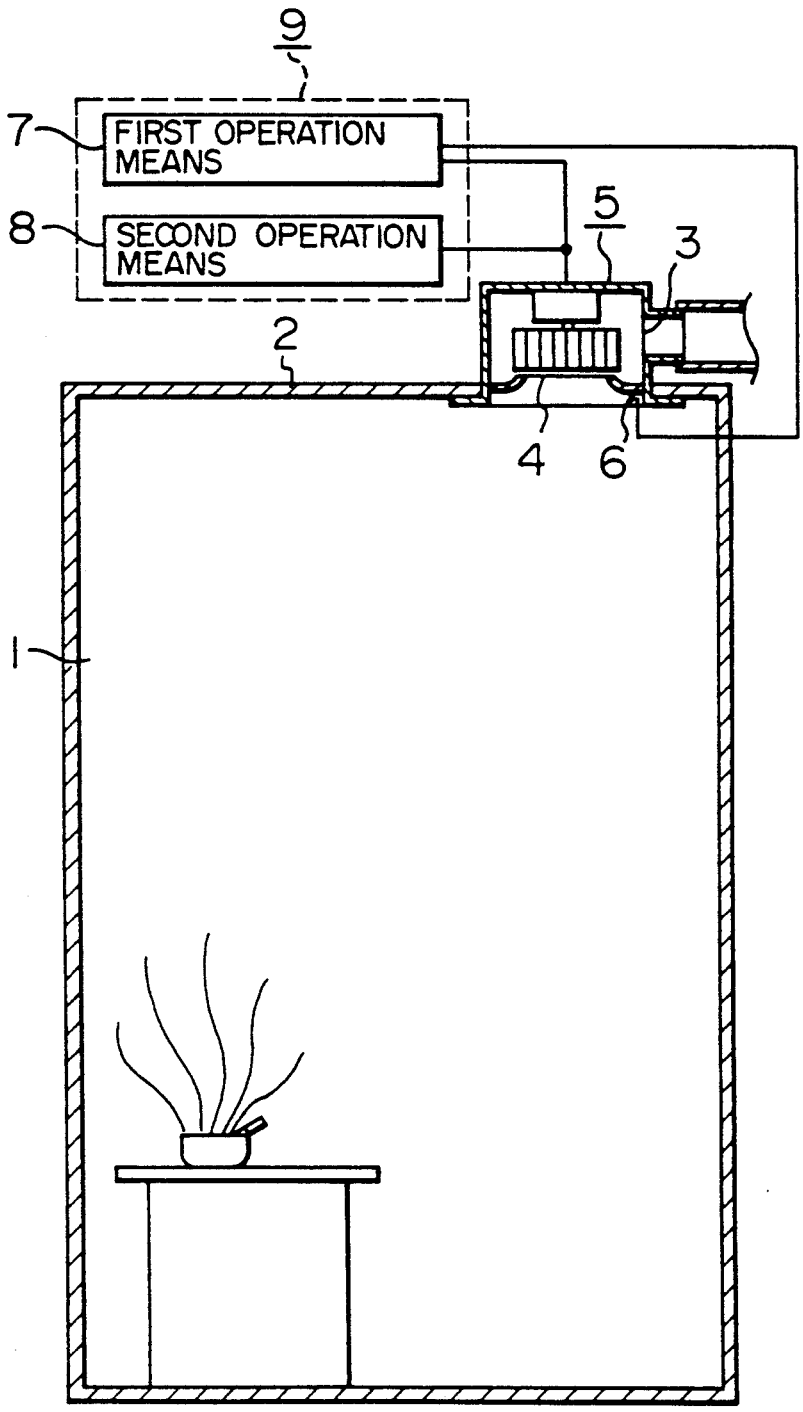
FIG. 1 is a block diagram showing an automatic operation apparatus for a ventilating fan in a first embodiment of the present invention.
Figure 2:
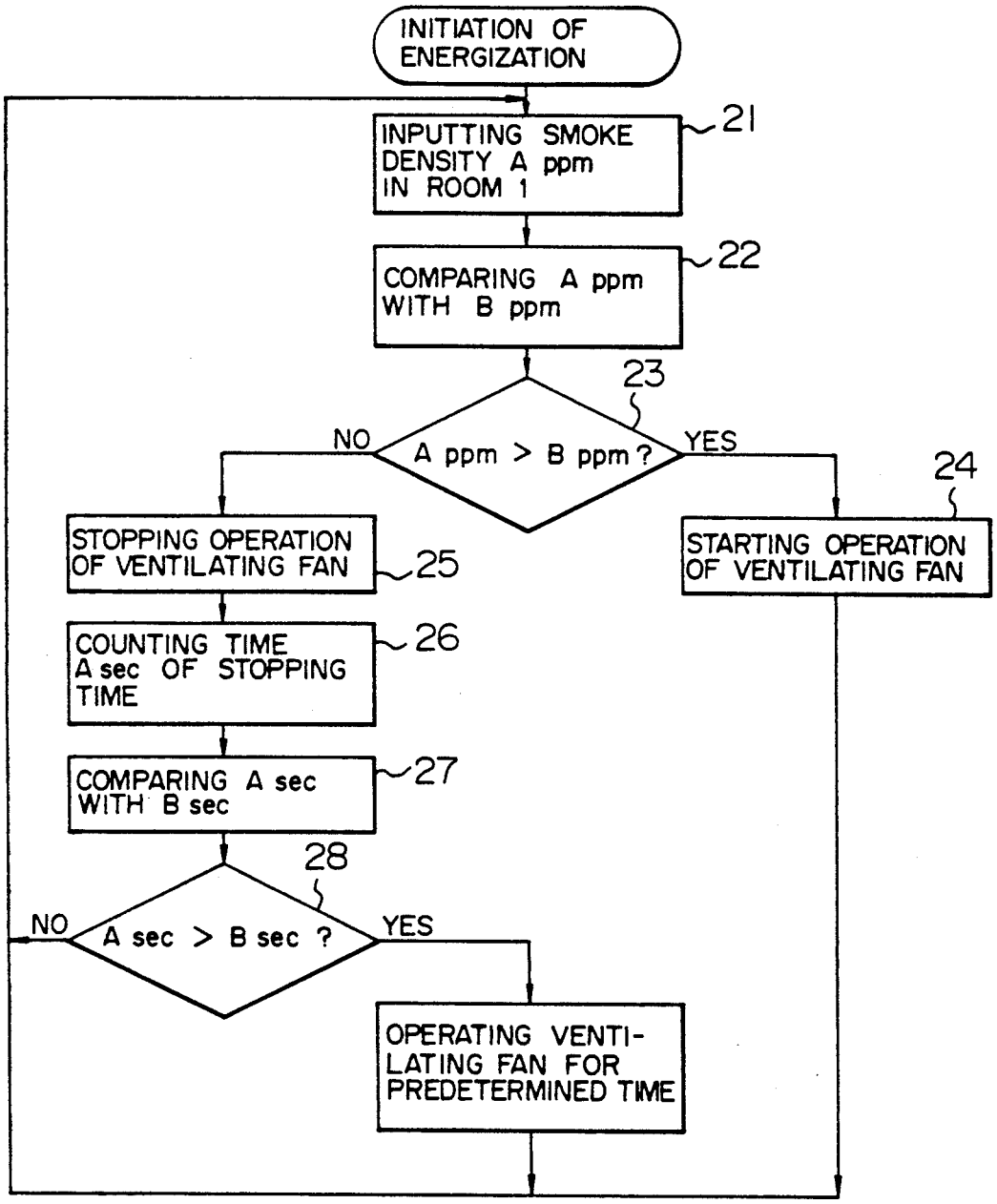
FIG. 2 is a flow chart for explaining the operation program for the automatic operation apparatus shown in FIG. 1.

Referring to FIG. 1, a ventilating fan 5 having a discharge port 3 at its one side surface and a suction port 4 at its lower surface is installed at the ceiling 2 of the room 1. A smoke sensor 6 for detecting a smoke density in a room 1 is provided in the vicinity of the suction port 4, and delivers its detection output to a first operation means 7 for starting and stopping the operation of the ventilating fan 5 in accordance with the detection output from the smoke sensor 6. Meanwhile, a difference in smoke density occurs between the area surrounding the user and the area around the smoke sensor so that the ventilating fan 5 remains stopping for a predetermined time since the room 1 in which the ventilating fan 5 is installed has a wide space or since the position of the installed ventilating fan 5 is high so that the distance between the smoke sensor 6 and a source of smoke is long, resulting in that generated smoke cannot reach the smoke sensor 6. In order to eliminate this problem a second operation means 8 for operating the ventilating fan 5 for a predetermined time so that contaminated air in the vicinity of the user can be led to the area around the smoke density detecting element and the smoke density in the room can be made to be uniform. It is noted that the first operation means 7 and the second operation means 8 are all materialized by a microcomputer 9.

Next, explanation will be made of operation of the automatic operation apparatus for the ventilating fan with reference to FIGS. 1 and 2.

First, at step 21, a smoke density A ppm in the room is inputted to the microcomputer 9 which compares the smoke density A ppm with a reference smoke density B ppm which has been stored beforehand in the microcomputer 9 at step 22. Then, at step 23, if it is determined that the smoke density A ppm is greater than the reference smoke density B ppm, the procedure is advanced to step 24 at which the operation of the ventilating fan 5 is started. Then, the procedure is returned to step 21. If it is determined at step 23, that the smoke density A ppm is smaller than the reference value B ppm, the procedure is advanced to step 25 at which the operation of the ventilating fan is stopped. Next, at step 26, the time A sec of stopping of the ventilating fan 5 is counted, and at step 27, the stopping time A sec is compared with a reference stopping time B sec which has been stored in the microcomputer 9. Then, if it is determined that the stopping time A sec does not exceed the reference stopping time B sec at step 28, the procedure is returned to step 21. On the contrary, if it is determined that the stopping time A sec exceeds the reference stopping time B sec at step 28, the ventilating fan 5 is operated for a predetermined time, and the procedure is returned to step 21. Thus, with the automatic operation apparatus for the ventilating fan according to the present invention, even if a difference in smoke density occurs between the area surrounding the user and the smoke sensor 6 so that the ventilating fan 5 would remain stopping for a predetermined time since smoke generated in the room 1 does not reach the smoke sensor 6, the ventilating fan 5 is operated for a predetermined time in order to lead the contaminated air in the vicinity of the user to the area around the smoke sensor 6 so that the smoke density in the room is made to be uniform, and the contaminated air can be surely discharged outside the room.

Figure 3:
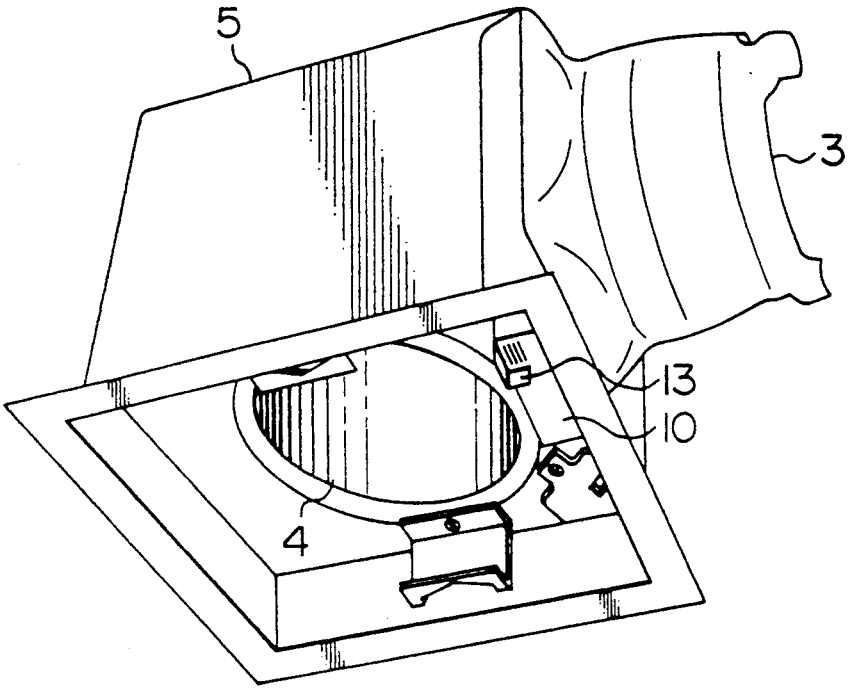
FIG. 3 is a perspective view illustrating a ventilating fan in a second embodiment of the present invention.
Figure 4:
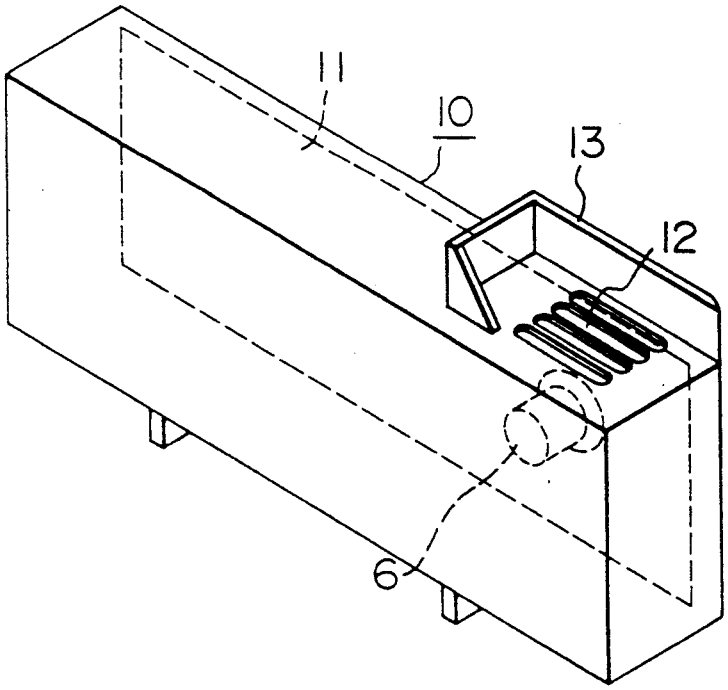
FIG. 4 is a perspective view illustrating a control circuit casing.
Figure 5:
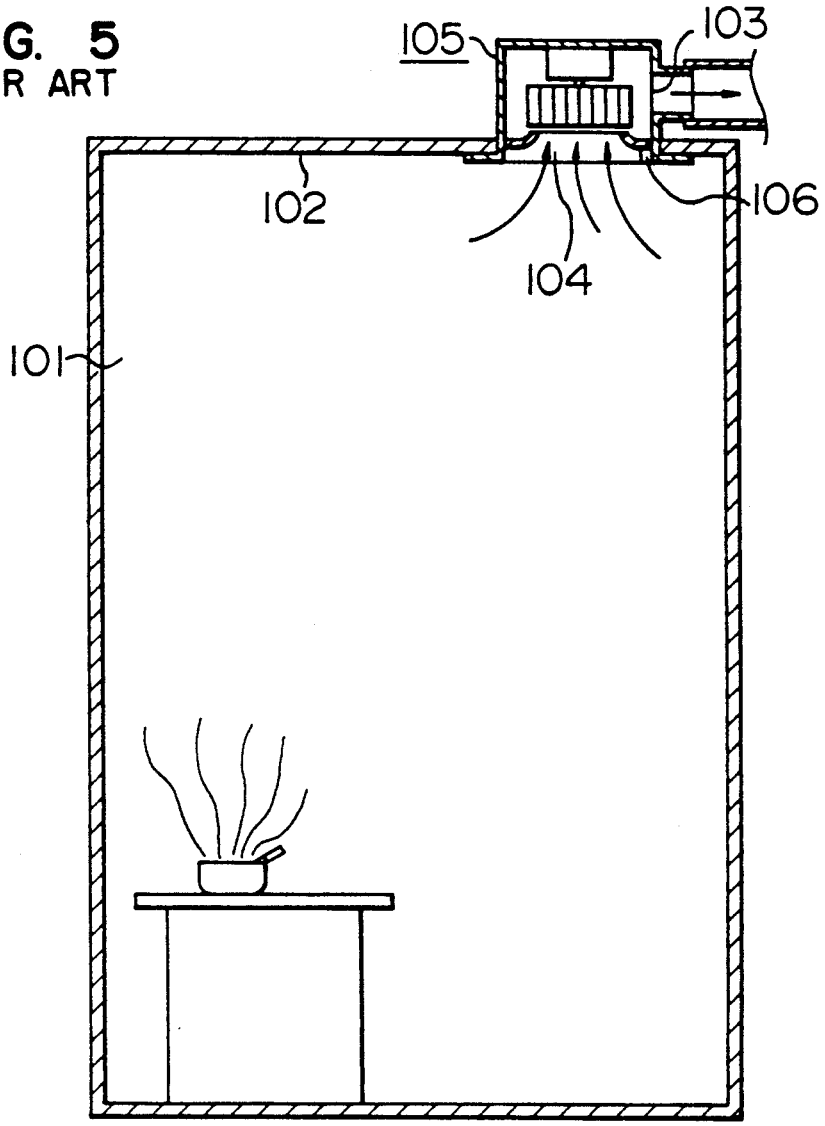
FIG. 5 PRIOR ART
FIG. 5 is a block diagram showing an automatic operation apparatus for a ventilating fan of related art.
Figure 8:
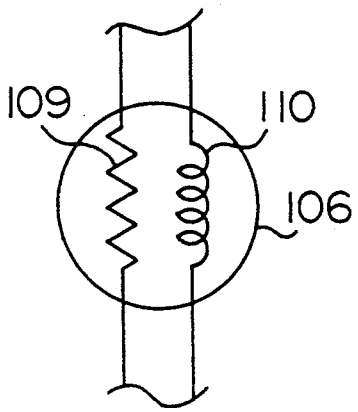
FIG. 8 is a smoke sensor disposed in the control circuit casing shown in FIG. 7.
Figure 6:
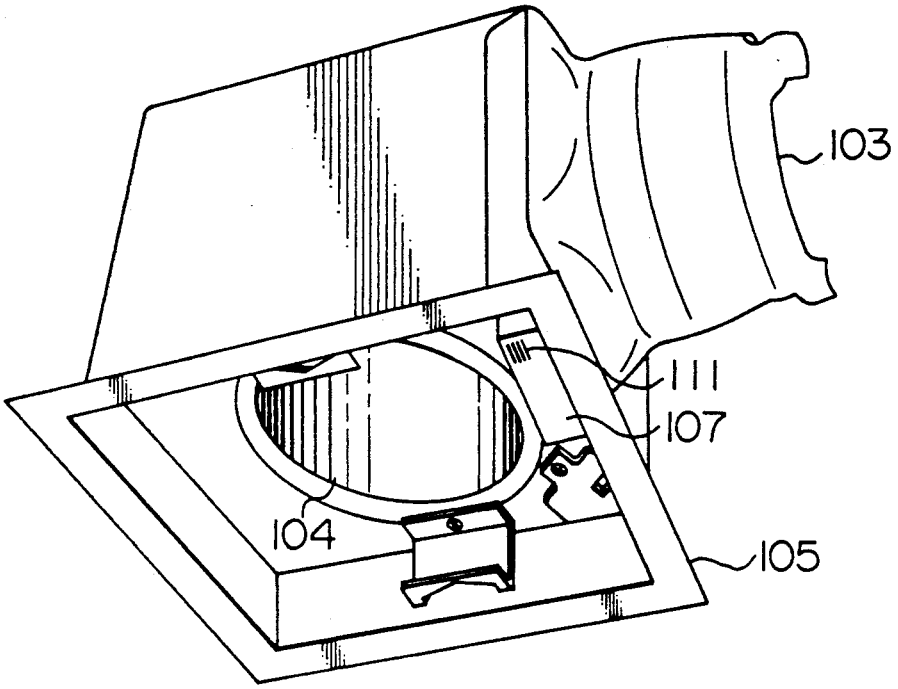
FIG. 6 PRIOR ART
FIG. 6 is a perspective view illustrating the ventilating fan in the automatic operation apparatus shown in FIG. 5.
Figure 7:
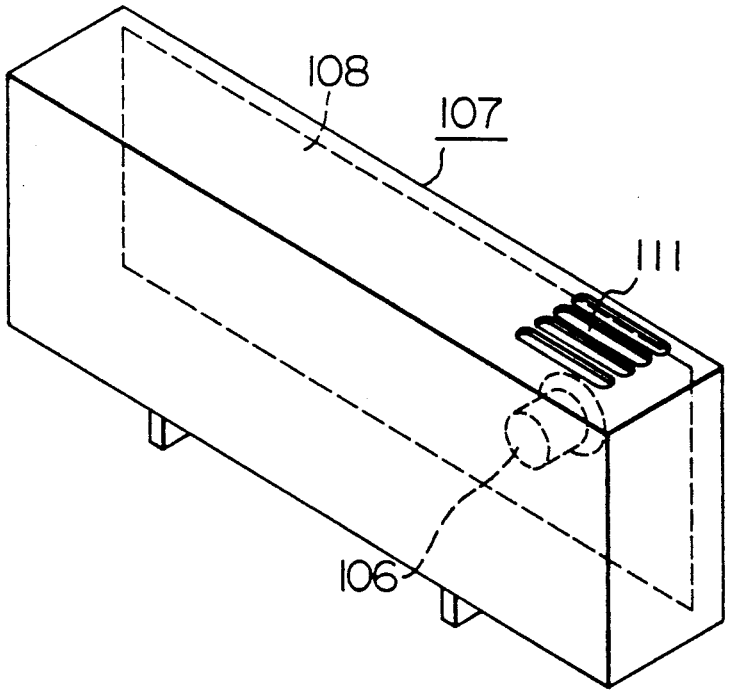
FIG. 7 PRIOR ART
FIG. 7 is a perspective view illustrating a control circuit casing in the automatic operation apparatus shown in FIG. 5.

Next, explanation will be made of an automatic operation apparatus in a second embodiment of the present invention with reference to FIGS. 3 and 4.

Referring to these figures, an electronic circuit board 11 on which a heat activation type smoke sensor 6 for detecting a density of smoke generated in a room is incorporated is disposed in a box-like control circuit casing 10 which is provided in a ventilating fan body 5 having a discharge port 4 at its side surface and a suction port 4 at its lower surface, in the vicinity of the suction port 4. Further, the smoke sensor 6 incorporates therein a smoke detection element of converting a smoke density into a resistance value, and a heater for heating the smoke detection element. An opening 12 for communicating the inside of the control circuit casing 10 with the inside of the room is formed at the lower surface of the control circuit casing 10 in the vicinity of the smoke sensor 6. Further, an air stream blocking plate 13 is provided, being projected downward, to the control circuit casing 10 in the vicinity of the smoke sensor 6. Further, an air stream blocking plate 13 is provided, being projected downward, to the control circuit casing 10 in the vicinity of the opening 12.

In the above-mentioned arrangement, smoke generated from a cigarette or the like in the room is led into the control circuit casing 10 through the opening 12. Further, the smoke sensor 6 detects the smoke so as to operate the ventilating fan in order to suck contaminated air from the room through the suction port 4 and to then discharge the same through the discharge port 3. At this time, the discharged air stream is blocked by the air stream blocking plate 13 so that it cannot dash below the opening 12, and accordingly, it is possible to prevent a heat from being sucked from the smoke detection element which has been heated in the control circuit casing 10, and accordingly, it is possible to prevent the smoke detecting element from being cooled down, thereby it is possible to precisely detect an actual smoke density without the smoke detection element being abruptly cooled down.

Although it has been explained in the above-mentioned embodiment that a heat activation type sensor is used as a smoke sensor for detecting the atmosphere in the room, but any other heat activation type sensors can be also used without being limited to the sensor explained in the embodiments.

As clearly understood from the above-mentioned explanation to the embodiments of the present invention, an automatic operation apparatus for a ventilating fan which can perform ventilation suitably coping with an atmosphere surrounding the user and which can prevent occurrence of a difference in smoke density between the area surrounding the user and the area around the smoke sensor even though the distance between the smoke sensor and a source of smoke is long so that generated smoke cannot reach the smoke sensor since the room in which the ventilating fan is installed has a wide space or the position of the installed ventilating fan is high.

Further, according to the present invention, since the stream blocking plate for preventing the stream of air is provided in the vicinity of the opening in the control circuit casing, there can be provided an automatic operation apparatus for a ventilating fan which suitably operates so as to prevent the sensor from failing to precisely detect an atmosphere in the room, being caused by a discharged air stream which is sucked through the suction port upon operation of the ventilating fan.

What is claimed is:

1. An automatic operation apparatus for a ventilating fan comprising:
   - a smoke sensor for detecting a smoke density in a room,
   - a first operation means for starting or stopping operation of said ventilating fan in accordance with a detection signal from said smoke sensor; and
   - a second operation means for operating said ventilating fan for a predetermined time if said ventilating fan remains stopping for a predetermined time.

2. An automatic operation apparatus as set forth in claim 1, wherein said second operation means counts a time from a time point when said first operation means stops said ventilating fan, and starts operation of said ventilating fan after a predetermined time elapses.

3. An automatic operation apparatus as set forth in claim 1, wherein said first operation means starts operation of said ventilating fan when an detection signal from said smoke sensor exceeds a reference value, and stops the operation of the ventilating fan when the detection signal is below the reference value.

4. An automatic operation apparatus for a ventilating fan as set forth in claim 1, wherein said smoke sensor is provided in a control circuit casing having an opening, said control circuit casing is arranged around the suction port of said ventilating fan, and an air stream blocking plate is provided around said opening in said control circuit box, being projected outward.

5. An automatic operation apparatus for a ventilating fan as set forth in claim 4, wherein said air stream blocking plate provided around the opening of said control circuit casing is projected so as to shield the opening along its periphery.

* * * * *